US012251791B2

(12) United States Patent
Miyasaka

(10) Patent No.: US 12,251,791 B2
(45) Date of Patent: Mar. 18, 2025

(54) METAL PRODUCT SURFACE MEMBER AND METHOD FOR BURNISHING SAME

(71) Applicant: FUJI KIHAN CO., LTD., Nagoya (JP)

(72) Inventor: Yoshio Miyasaka, Nagoya (JP)

(73) Assignee: FUJI KIHAN CO., LTD., Nagoya (JP)

( * ) Notice: Subject to any disclaimer, the term of this patent is extended or adjusted under 35 U.S.C. 154(b) by 766 days.

(21) Appl. No.: 17/258,305

(22) PCT Filed: Dec. 13, 2018

(86) PCT No.: PCT/JP2018/045956
§ 371 (c)(1),
(2) Date: Jun. 20, 2022

(87) PCT Pub. No.: WO2020/044585
PCT Pub. Date: Mar. 5, 2020

(65) Prior Publication Data

US 2023/0191560 A1 Jun. 22, 2023

(30) Foreign Application Priority Data

Aug. 31, 2018 (JP) ..... 2018-163198

(51) Int. Cl.
*B24C 1/10* (2006.01)
*B24B 39/00* (2006.01)
(Continued)

(52) U.S. Cl.
CPC ..... *B24C 1/10* (2013.01); *B24B 39/00* (2013.01); *B24C 1/00* (2013.01); *B24C 11/00* (2013.01);
(Continued)

(58) Field of Classification Search
CPC .. B24C 1/10; B24C 1/00; B24C 11/00; B24C 1/06; B24C 1/08; B24B 39/00; C21D 7/06; C21D 7/08
See application file for complete search history.

(56) References Cited

U.S. PATENT DOCUMENTS 4,250,950 A * 2/1981 Buxmann ..... B22D 11/0654 249/141
4,258,084 A * 3/1981 Hayden, Sr. ..... B24C 1/10 123/193.2
(Continued)

FOREIGN PATENT DOCUMENTS

CN 101850540 A 10/2010
CN 102371542 A 3/2012
(Continued)

OTHER PUBLICATIONS

Corresponding International Application No. PCT/JP2018/045956 International Search Report dated Feb. 19, 2019, 5 pages.
Corresponding Chinese Application No. CN201880095961.1 , Chinese Office action dated Jun. 13, 2022.

*Primary Examiner* — Ryan J. Walters
(74) *Attorney, Agent, or Firm* — Ronald M. Kachmarik; Cooper Legal Group LLC

(57) ABSTRACT

The present invention improves surface roughness by knocking down protruding parts while leaving recessed parts in the surface of a metal product, protrusions/recesses having been formed in said surface via blasting, and improves surface hardness and compressive residual stress. Treatment is performed upon a metal product in which protrusions/recesses have been formed in the surface thereof via blasting. Spherical shot that are less hard than the surface hardness of the metal product and have a particle size that is greater than the width of recessed parts of the protrusions/recesses are sprayed toward and collide against the surface of the metal product as crushing shot, and the protruding
(Continued)

parts of the protrusions/recesses formed on the surface of the metal product are selectively knocked down, thereby providing a metal product surface member in which the surface roughness of the metal product has been improved.

3 Claims, 13 Drawing Sheets

(51) Int. Cl.

| | |
|---|---|
| ***B24C 1/00*** | (2006.01) |
| ***B24C 11/00*** | (2006.01) |
| ***C21D 7/06*** | (2006.01) |
| ***C21D 7/08*** | (2006.01) |
| *B24C 1/06* | (2006.01) |
| *B24C 1/08* | (2006.01) |

(52) U.S. Cl.
CPC ..... *C21D 7/06* (2013.01); *C21D 7/08* (2013.01); *B24C 1/06* (2013.01); *B24C 1/08* (2013.01)

(56) References Cited

U.S. PATENT DOCUMENTS

| | | | | |
|---|---|---|---|---|
| 5,592,840 | A | 1/1997 | Miyasaka | |
| 9,108,298 | B2 * | 8/2015 | Mase | B29C 45/263 |
| 10,758,968 | B2 * | 9/2020 | Mase | B22C 9/061 |
| 2003/0128903 | A1 | 7/2003 | Yasuda | |

FOREIGN PATENT DOCUMENTS

| | | | | |
|---|---|---|---|---|
| JP | 1-92069 | A | | 4/1989 |
| JP | 2-185370 | A | | 7/1990 |
| JP | 7-188738 | A | | 7/1995 |
| JP | 7-290363 | A | | 11/1995 |
| JP | H07290363 | A | | 11/1995 |
| JP | 10166271 | A | * | 6/1998 |
| JP | 2003-184883 | A | | 7/2003 |
| JP | 2005-161419 | A | | 6/2005 |
| JP | 2009131882 | A | | 6/2009 |
| JP | 2010-265926 | A | | 11/2010 |
| JP | 2012-040744 | A | | 3/2012 |
| JP | 2012223873 | A | | 11/2012 |
| JP | 5341971 | B2 | | 11/2013 |
| JP | 2014-122652 | A | | 7/2014 |

* cited by examiner

Test Example 1 (untreated)

Test Example 1
(after indentation-protrusion forming processing)

Test Example 1
(after follow-up processing)

Test Example 2 (untreated)

Longitudinal magnification : 0. 2 μm/cm
Orthogonal magnification : 50 μm/cm

Test Example 2
(after indentation-protrusion forming processing)

Test Example 2

After burnishing processing
(under Condition 1)

Longitudinal magnification : 0.5 μm/cm
Orthogonal magnification : 50 μm/cm

Test Example 2

After burnishing processing
(under Condition 2)

Longitudinal magnification : 0.5 μm/cm
Orthogonal magnification : 50 μm/cm

Test Example 2

After burnishing processing
(under Condition 3)

Test Example 3 (untreated)

P Profile

F Profile

Longitudinal magnification : 5 μm/cm
Orthogonal magnification : 200 μm/cm

Test Example 3 (after indentation-protrusion forming processing)

P Profile

F Profile

Longitudinal magnification : 5 μm/cm
Orthogonal magnification : 200 μm/cm

×2000
×50

Test Example 3 (after burnishing processing)

P Profile

F Profile

Longitudinal magnification : 5 μm/cm ×2000
Orthogonal magnification : 200 μm/cm ×50

METAL PRODUCT SURFACE MEMBER AND METHOD FOR BURNISHING SAME

BACKGROUND OF THE INVENTION

1. Field of the Invention the present invention relates to a metal product surface member and to a burnishing method for the metal product surface member. More particularly the present invention relates to a metal product surface member with improved surface roughness achieved by taking as a treatment target a metal product including a surface having indentations and protrusions formed thereon by blast processing (including shot peening), and pressing and collapsing the protrusions from out of the indentations and the protrusions formed on the metal product surface while preserving the indentations. The present invention also relates to a burnishing method to obtain the surface member.

2. Description of the Related Art

As a result of demands for energy savings and increased speeds in automobiles, construction machinery, and the like, low viscosity products are now being employed as lubrication oils used to lubricate engines and other sliding components.

Using such low viscosity lubrication oils enables a reduction in friction loss to be achieved in fluid lubricated regions, thereby answering such demands for energy savings and increased speeds. However, in situations in which low viscosity lubrication oils are employed, there is a greater likelihood that the thickness of oil film formed on the surface of sliding parts will thin, and that breaks will appear in the oil film. This makes seizing more liable to occur between sliding parts.

In order to prevent breaks in oil films and seizing from occurring with the use of low viscosity lubrication oils, there are accordingly proposals to form innumerable fine indentations on the surface of sliding parts of metal products, and to prevent such occurrences of the oil film breaking and the seizing that results therefrom by being able to retain lubrication oils inside such indentations.

Note that when such innumerable fine indentations are formed, for example, on a molding surface of a mold for molding a resin, advantageous effects such as improved demoldability for the mold are obtained due to release agent and air being trapped inside these indentations. The target for forming such innumerable fine indentations on is accordingly not limited to the sliding components mentioned above, and such forming may be utilized in various fields.

Forming the fine indentations on the surface of a metal product as described above is, for example, performed by utilizing "blast processing", in which particles are caused to collide a surface of a workpiece by carrying the particles on a jet of compressed air, or by ejecting the particles using centrifugal force or striking.

The particles ejected in blast processing have, for example, a higher hardness than the hardness of the base material of the metal product serving as the treatment target, and particles having a substantially spherical shape called "shot" are employed in cases in which shot peening is performed. As illustrated in FIG. 1, substantially semi-circular arc shaped indentations (dimples) can be formed by causing plastic deformation and depressions to occur on the surface of a metal product at portions collided by the shot, and these indentations (dimples) exhibit the function of oil traps and the like as described above.

Moreover, in cases in which indentations are formed by shot peening in such a manner, as well as compressive residual stress being imparted to the surface of the metal product by the plastic deformation that occurs when collided by shot, the surface of a metal product can also be strengthened by instantaneous heat treatment that occurs with a localized and instantaneous rise in temperature of the surface of the metal product at the portions collided by shot. The fatigue strength of the metal product is accordingly raised at the same time as forming the indentations, and an improvement in durability and wear resistance can be achieved at the same time (see Patent Document 1).

However, the formation of indentations by shot peening as described above is achieved by the base material of the metal product plastically deforming under the collision from spherical shaped shot, as illustrated in FIG. 1. This means that not only are indentations formed on the surface of the metal product at portions collided by the shot, however protrusions are also formed at the same time by the base material of metal present at the portions where the indentations are formed being pushed out to the periphery thereof.

In cases in which protrusions generated on the surface of the metal product in this manner are generated on the surface of a sliding component, this increases contact resistance arising from contact with the surface of a counterpart member. Moreover, in cases in which such protrusions are generated on the surface of a molding surface of a mold, then these protrusions dig into the molded member and causes a deterioration in demoldability.

Thus in cases in which processing to form indentations is performed to a surface of a sliding part, to a molding surface of a mold, or to a surface of another metal product, preferably the surface roughness of the metal product is improved such as by removing, or pressing and collapsing the tip portions of the protrusions so as to reduce the height thereof, in a manner that preserves the indentations to serve as oil traps etc.

As a method to reduce the height of the protrusions while preserving the indentations from out of the indentations and protrusions formed on the surface of a metal product in this manner, a method might be considered of cutting off the protrusions at a specific height by polishing using abrasive grains, as in lapping, buffing finishing, or the like.

Moreover, as a method to reduce the height of such protrusions and improve the surface roughness of a metal product, a method that might be considered is to apply burnishing to press and collapse the protrusions down to a specific height by passing a tool with a smooth surface, such as a roller, across the surface of the metal product while pressing the tool against the surface.

Moreover, as a method to remove protrusions generated between one indentation and another indentation by forming the indentations using blast processing, there is a proposal to cut off the tip sides of the protrusions down to a specific height by ejecting an abrasive in such a manner that the abrasive slides along the surface of the metal product (see Patent Document 2).

PRIOR ART DOCUMENTS

Patent Documents

Patent Document 1: Japanese Patent No. 5341971
Patent Document 2: Japanese Patent Application Laid-Open No. 2012-04744

Problems to be Solved by the Invention

From out of the methods described above, in the method in which after forming the indentations and protrusions, the protrusions generated on the surface of a metal product are cut off by lapping or buffing, differences in the surface state after processing occur according to the skill of the worker, and it is also difficult to achieve uniform processing across the entire surface even for a skilled worker. In particular, there are difficulties even performing the processing itself for surfaces with complicated shapes, and for surfaces that include corners formed where one surface meets another surface, as well as for surfaces that include grooves, holes, or the like.

Moreover, the improvement in surface roughness is achieved in such a method by cutting off part of the surface of the metal product using abrasive grains. This means that a surface layer of a metal product, which was strengthened by compressive residual stress imparted and instantaneous heat treatment when forming the indentations and protrusions on the surface of the metal product, is also partly removed by the abrasive.

Moreover, in case an attempt is made to strengthen the surface by imparting work hardening and compressive residual stress while lapping and buffing polishing, then a high working pressure would be needed, and there would also be a concern that as a result of the increased polishing, cutting might progress as far as the indentations and result in their elimination.

In contrast thereto, in known burnishing processing in which a tool with a smooth surface such as a roller is passed across the surface of the workpiece while being pressed against the surface, the surface roughness is improved by the protrusions generated on the surface of the metal product being pressed and collapsed by plastic deformation accompanying contact with the tool surface. This would be expected to achieve a further strengthening of the surface of the metal product due to work hardening and compressive residual stress imparted during the plastic deformation when performing the pressing and collapsing.

As a trial, roller burnishing was performed on the surface of a metal product that had innumerable semi-circular arc shaped indentations formed thereon by blast processing using fine spherical shaped shot. Improved surface roughness could be confirmed on the surface of the metal product after processing by roller burnishing had been performed, due to reducing the height of the protrusions while preserving the indentations by selectively pressing and collapsing the protrusions from out of the indentations and protrusions. However, in contrast to the expectation stated above, a reduction was actually confirmed in surface hardness of the metal product after roller burnishing had been performed, compared to the metal product prior to performing roller burnishing. The conclusion was accordingly reached that when surface roughness was improved by this method, there was a loss of the surface strengthening effect that had been imparted by the blast processing performed to form the indentations and protrusions.

Moreover, processing a surface having a complicated shape or including corners, grooves, holes and the like is difficult using known burnishing method such as roller burnishing.

Note that, as introduced in the Patent Document 2, in a configuration for removing the tips of protrusions, which had been generated when the indentations and protrusions were formed by blast processing, by ejecting an abrasive in such a manner that the abrasive flows over the surface of the metal product, removing the tips of the protrusions is comparatively simple to perform using a blasting apparatus similar to that employed when forming the indentations and protrusions. This enables uniform processing to be achieved in a short time and without the need for skill.

Moreover, this method is also comparatively easy to perform even for complicated surface shapes, and surface shapes including angles, grooves, holes and the like, while also enabling uniform processing.

However, the cost is higher to cause abrasive to slide along the surface of a metal product using this method, than the cost when processing is performed using known ordinary shot or abrasive grains, due to needing to employ a special abrasive. Special abrasives include "elastic abrasives" in which an abrasive (abrasive grains) is supported on the surface of an elastic material such as rubber, or abrasive (abrasive grains) is kneaded into an elastic material, as well as "plate shaped abrasives" having a flat shape (see paragraphs [0057], [0044], and [0045] of Patent Document 1).

Moreover, no uplift in compressive residual stress and surface hardness can be achieved by processing to remove the tips of the protrusions.

Note that the description above describes an example in which the protrusions removed are protrusions formed when substantially semi-circular arc shaped indentations (dimples) were formed on the surface of the metal product by shot peening, as explained with reference to FIG. 1. However, the problems which arise when the protrusions are present on the surface of the metal product, such as increased contact resistance, a deterioration in demoldability, and the like, are common problems that also occur in cases in which particles having cutting properties, such as abrasive grains, angular grits, and the like are ejected against the surface of a metal product to form, for example, saw tooth shaped indentations and protrusions. In cases in which indentations and protrusions have been formed by any method, there is accordingly a desire to be able to achieve advantageous effects such as reduced sliding resistance and improved demoldability by collapsing the tips of protrusions while preserving the indentations of the indentations and protrusions, so as to improve surface roughness.

The present invention has accordingly been arrived at to solve the deficiencies of related technology described above, and an object of the present invention is to provide a metal product surface member capable of achieving the advantageous effects of improved surface roughness and raised surface hardness and compressive residual stress in a metal product, while being able to perform processing to press and collapse the tips of protrusions and to improve the surface roughness of the metal product, while preserving the indentations, from out of the indentations and protrusions that were generated when the indentations and protrusions were formed on the surface of a metal product by blast processing as described above, by processing that can be performed uniformly and at low cost by a comparatively simple operation not requiring skill. An object of the present invention is also to provide a burnishing method as a processing means for such a metal product surface member.

SUMMARY OF INVENTION

Means for Solving the Problem

In order to achieve the above objective, a metal product surface member of the present invention is characterized by comprising a metal product including a surface formed with innumerable fine indentations, wherein by burnishing:

indentations from out of indentations and protrusions formed have indentation widths lying in a range of from 0.1 μm to 12 μm and averaging from approximately 5 μm to approximately 6 μm; and the protrusions from out of the indentations and the protrusions formed on the metal product surface are selectively pressed and collapsed to give a surface roughness Ra of from 0.196 μm to 0.060 μm.

The surface member may be a sliding surface.

The surface member may be a molding surface of a mold for molding a resin.

In order to achieve the above objective, a method of burnishing a metal product surface member of the present invention comprises:

using a metal product including a surface having indentations and protrusions formed by blast processing as a treatment target; and ejecting spherical shaped shot having a lower hardness than a surface hardness of the metal product and a particle diameter larger than a width of a substantially semi-circular arc shaped indentation from out of the indentations and the protrusions against the metal product surface as crushing shot, and causing the crushing shot to collide the metal product surface so as to selectively press and collapse the protrusions from out of the indentations and protrusions formed on the surface of the metal product and improve a surface roughness of the metal product.

Ejection of the crushing shot may be performed at an ejection pressure of from 0.1 MPa to 0.7 MPa or at an ejection velocity of from 30 m/s to 300 m/s.

Furthermore, a burnishing method of the present invention is characterized in that:

the metal product serving as the treatment target has indentations and protrusions formed on a surface by ejecting, as indentation-protrusion forming shot, spherical shaped shot having a hardness that is not less than a hardness of a base material of the metal product serving as the treatment target and selected from a range of 100 grit to 800 grit (an average particle diameter of from 20 μm to 149 μm) against the surface of the metal product; and shot employed as the crushing shot has a particle diameter larger than that of the indentation-protrusion forming shot and is selected from a range of from 24 grit to 700 grit (an average particle diameter of from 24 μm to 840 μm).

In the case, preferably, the particle diameter of the crushing shot is in a range of from 1.2 times to 8.3 times the particle diameter of the indentation-protrusion forming shot.

Effect of the Invention

Configuring the present invention as described above enables the following significant advantageous effects to be obtained.

The surface roughness of the metal product can be improved by using a comparatively simple method of ejecting crushing shot to selectively press and collapse the protrusions from out of the indentations and protrusions that had been generated on the surface of the metal product having indentations and protrusions formed thereon by blast processing. This is achieved by collapsing the tip portions of the protrusions to reduce the height of the protrusions, while preserving the indentations to function as oil traps and the like.

As a result, not only does the metal product surface member of the present invention achieve improved lubricity and improved demoldability due to the indentations being formed thereon, but the advantageous effects of reduced sliding resistance and improved demoldability can be obtained at the same time due to the tip portions of the protrusions being flattened by pressing and collapsing.

Moreover, with the metal product that has had burnishing processing performed thereon by the method of the present invention, a rise in the surface hardness and compressive residual stress occurs from before to after the burnishing processing. A combination of the advantageous effects such as improved fatigue strength of the metal product and improved durability and wear resistance thereof can accordingly be obtained thereby.

In particular, in a configuration in which the forming of the indentations and protrusions on the surface of the metal product was performed by shot peening using fine shot of 100 grit to 800 grit (average particle diameter of from 20 μm to 149 μm), further enhancements to the advantageous effects such as improved fatigue strength of the metal product, and improved durability and wear resistance thereof can be obtained by superimposing increases in the compressive residual stress and improvements in the surface hardness by performing the burnishing processing, while maintaining the advantageous effects of compressive residual stress imparted and increased surface hardness accompanying instantaneous heat treatment when the indentations and protrusions were formed.

Moreover, the crushing shot employed in the method of the present invention may be any shot that satisfies the conditions for hardness, particle diameter, and the like given above in relation to the metal product serving as the treatment target and in relation to the indentation-protrusion forming shot. Due to being able to use shot selected from out of known ordinary shots used in shot blasting and shot peening, the surface roughness can be improved at a lower cost than in cases in which, as in the related technology introduced in Patent Document 2, a special abrasive, and therefore higher cost abrasive, is employed such as an elastic abrasive, plate shaped abrasive, or the like.

DETAILED DESCRIPTION OF THE PREFERRED EMBODIMENTS

Explanation follows regarding a burnishing method of the present invention.

Treatment Target

Figure 1:
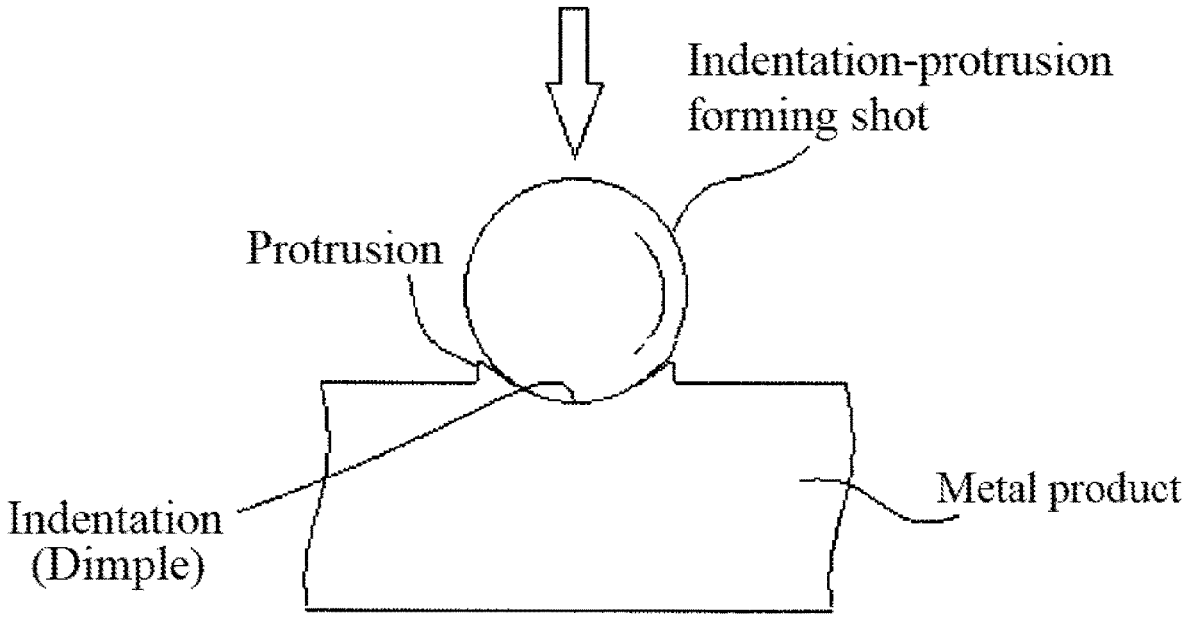
FIG. 1 is a schematic diagram to explain a state in which indentations and protrusions are formed by collision from indentation-protrusion forming shot.

The burnishing method of the present invention may employ as the treatment target metal products in general that include a surface having indentations and protrusions formed thereon by blast processing, and may be applied to the metal product explained with reference to FIG. 1 having innumerable semi-circular arc shaped indentations (dimples) formed thereon by so-called "fine particle peening" performed by the ejection of fine spherical shaped shot having a higher hardness than the hardness of the base material of the metal product. Application may also be made to a metal product including a surface having cuts formed thereon by blast processing using particles with cutting properties such as abrasive grains, grits, and the like, such as a metal product including a surface having saw tooth shaped indentations and protrusions formed thereon.

There are no particular limitations to the usage application of the metal product serving as the treatment target, and the metal product may be employed in any application in general that employs a surface having innumerable fine indentations formed thereon. Examples of metal products that may be employed as the treatment target for the method of the present invention include: sliding components in an engine that include a surface having indentations formed thereon to serve as oil traps for lubrication oil, such as a cam shaft, a follower, a piston skirt, a piston seal, a cylinder bore, a crank shaft, a bearing surface, or the like; and molds including a molding surface having indentations formed thereon to serve as release agent traps or air traps, such as molds for molding resins.

There are no particular limitations to the substance of the metal product serving as the treatment target of the present invention. Any metal material that is plastically deformable so as to enable protrusions from out of indentations and protrusions to be crushed by the collision of crushing shot may be employed, irrespective of the substance. Products made from various substances may serve as the treatment target, and in addition to products made from ferrous metals such as steels etc., products made from non-ferrous metals, and made from alloys thereof, may also be the target of treatment.

The indentations and protrusions formed on the surface of such metal products are preferably indentations and protrusions that were formed by the ejection and collision of spherical shaped shot having a higher hardness than the base material of the metal product treatment target, and serving as indentation-protrusion forming shot.

Such indentation-protrusion forming shot is selectable from a range of from 100 grit to 800 grit (average particle diameter from 20 μm to 149 μm), and there are no particular limitations to the substance thereof as long as it has a higher hardness than that of the base material of the metal product serving as the treatment target. Known shots of various substances may be employed, such as shots made from a steel or other metal, made from ceramics, or made from glass.

The ejection of particles to form the indentations and protrusions may be performed, for example, at an ejection pressure of from 0.3 MPa to 0.6 MPa, or may be performed at an ejection velocity of from 100 m/s to 200 m/sec. This results in the surface of the metal product having innumerable indentations with a diameter of from 0.1 μm to 5 μm formed thereon. The diameter of the indentations is smaller than the particle diameter of the indentation-protrusion forming shot employed.

There is no particular limitation to the method of employed to eject the particles to form the indentations and protrusions on the surface of the metal product. Various known blasting apparatuses capable of ejecting particles at the ejection pressures or ejection velocities listed above may be employed therefor.

Examples of such blasting apparatuses include: air type blasting apparatuses that eject shot carried on a jet of compressed air; centrifugal type blasting apparatuses that accelerate and eject shot using centrifugal force; and strike type blasting apparatuses that accelerate and eject shot by causing the shot to collide an impeller rotating at high speed and strike the shot. Any of such blasting apparatuses may be employed. A metal product having indentations and protrusions formed thereon by using one of these blasting apparatuses may be employed as the target for the burnishing method of the present invention.

Burnishing Processing

In the burnishing method of the present invention, the treatment target is, as described above, a metal product with indentations and protrusions formed thereon by blast processing. Spherical shaped crushing shot is ejected against and caused to collide the surface of the metal product, so as to use the crushing shot to selectively press and collapse the protrusions, from out of the indentations and protrusions that had been generated on the surface of the metal product. The surface roughness is thereby improved by reducing the height of the protrusions while preserving the indentations.

In cases in which the metal product serving as the treatment target has indentations and protrusions formed thereon by blast processing using particles with cutting properties such as grits and the like, which are abrasive grains and angular projection materials, the widths of the indentations formed on the surface of the metal product may be larger than the particle diameter of the particles that were employed to form the indentations and protrusions. This means that for the crushing shot employed for the burnishing processing, the crushing shot employed should have a larger particle diameter than the width of the substantially semi-circular arc shaped indentations (i.e. the diameter of peripheral edge demarcating the outline of the indentations) formed in the surface of the metal product.

Moreover, in cases in which the metal product serving as the treatment target has indentations and protrusions formed thereon by blast processing (fine particle peening) using indentation-protrusion forming shot that is fine spherical shaped shot having a higher hardness than that of the base material of the metal product, the width of the indentations formed on the surface of the metal product is normally not greater than the diameter of the indentation-protrusion forming shot. In such cases shot having a larger particle diameter than the indentation-protrusion forming shot may be employed as the crushing shot employed in the burnishing processing.

For example, when shot selected from a range of 100 grit to 800 grit (average particle diameter from 20 μm to 149 μm) is selected as the indentation-protrusion forming shot, the crushing shot may employ shot selected from a range of from 24 grit to 700 grit (average particle diameter from 24 μm to 840 μm) so as to have a particle diameter larger than that of the indentation-protrusion forming shot. Preferably the particle diameter of the crushing shot employed is from 1.2 times to 8.3 times the particle diameter of the indentation-protrusion forming shot.

Note that whichever of the above metal products is serving as the treatment target, the crushing shot employed has a lower hardness than the surface hardness of the metal product formed with the indentations and protrusions.

The substance employed for the crushing shot is not particularly limited as long as the crushing shot satisfies the above-listed hardness and particle diameter conditions, and known shots of various substances may be employed therefor, such as metal-based, ceramic-based, and glass-based shots.

Moreover, the crushing shot ejected against the surface of the metal product is ejected at an ejection pressure or ejection velocity selected according to the surface hardness of the metal product and the particle diameter and substance of the crushing shot employed, and is selected from a range of from 0.1 MPa to 0.7 MPa ejection pressure, or from 30 m/s to 300 m/s ejection velocity.

Various known types of blasting apparatus capable of dry-ejecting the crushing shot at the above ejection velocities or ejection pressures may be employed as the method to eject crushing shot against the surface of the metal product. Similar blasting apparatuses to those employed when forming the indentations and protrusions on the surface of the metal product, such as a centrifugal type, strike type, or air type blasting apparatus, may also be employed for crushing shot ejection.

However, an air type blasting apparatus is preferably employed from out of the above, due to this making it comparatively easy to adjust the ejection velocity and ejection pressure.

There are various blasting apparatuses that may be employed as such an air type blasting apparatus. These include a direct pressure type blasting apparatus in which compressed air is supplied into a tank filled with shot, and shot that is being conveyed by compressed air is then carried on a separately provided jet of compressed air jet and ejected by a blast gun, a gravity type blasting apparatus in which shot falling from a tank is carried on compressed air and ejected, and a suction type blasting apparatus in which shot is suctioned by a negative pressure generated by ejecting compressed air and then ejected together with the compressed air. Any of these blasting apparatuses may be employed, and various types of blasting apparatus capable of ejecting crushing shot at the ejection pressures or ejection velocities listed above may be employed, without limitation to the types given as examples above.

Advantageous Effects Etc.

Figure 2:
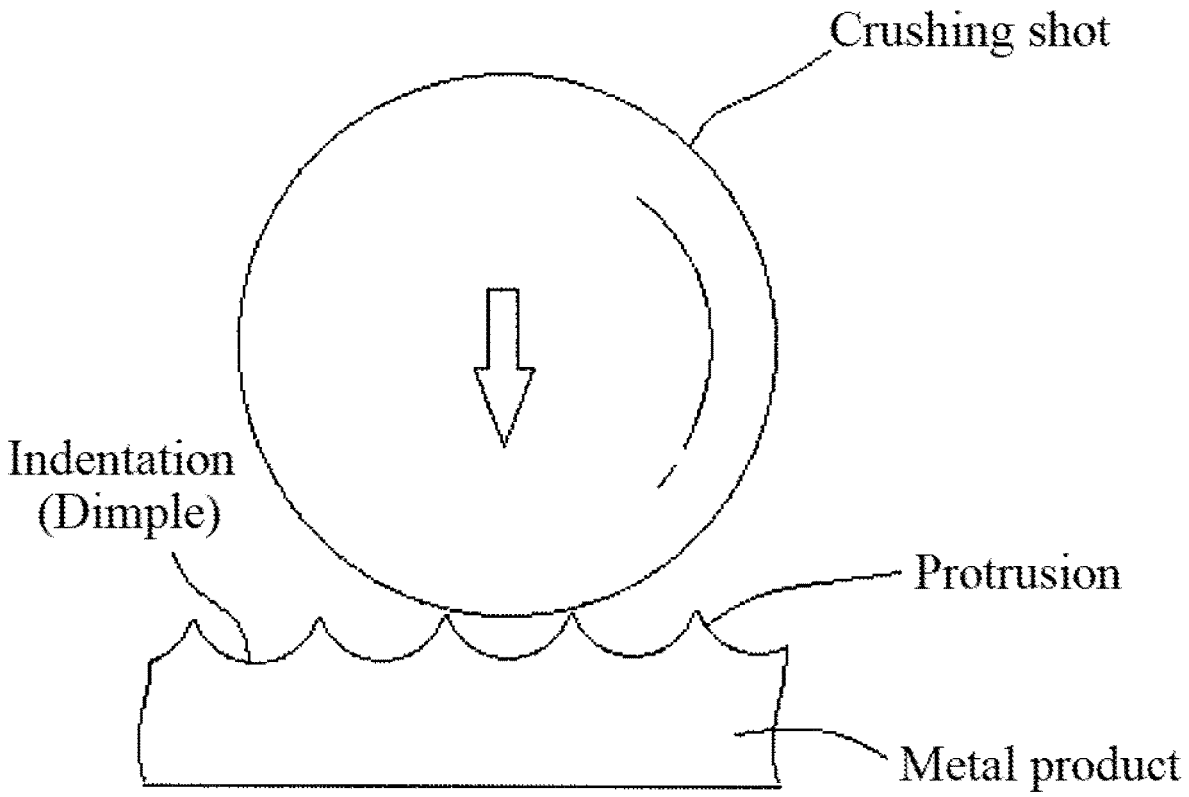
FIG. 2 is a schematic diagram to explain how protrusion crushing is performed using crushing shot.

As illustrated in FIG. 2, when crushing shot having a particle diameter larger than the width of the substantially semi-circular arc shaped indentations (i.e. larger than the diameter of the peripheral edge demarcating the outline of the indentations) formed on the surface of the metal product are ejected against the metal product surface having indentations and protrusions formed on the surface by blast processing, the crushing shot first collides the protrusions from out of the indentations and protrusions formed on the metal product surface.

Although this crushing shot is formed from a substance of lower hardness than the surface hardness of the metal product, the protrusions produced on the surface of the metal product have a pointed shape, as schematically illustrated in FIG. 2. The tip vicinity is accordingly easily deformed, and the tip portions are easily deformed and pressed and collapsed by collision from the crushing shot, so as to flatten the tip portions and reduce the height thereof.

However, when the crushing shot configured with a lower hardness than the surface hardness of the metal product collides the surface of the metal product, more deformation occurs on the crushing shot side than on the metal product side, such that deformation of the surface of the metal product is not liable to occur.

As a result the height of the protrusions is reduced by selectively pressing and collapsing just the tips of the protrusions, while preserving the indentations from out of the indentations and protrusions that were formed on the metal product surface by blast processing. The surface roughness of the metal product is improved thereby.

Moreover, in the burnishing method of the present invention, compressive residual stress is imparted to the surface of the metal product and the surface hardness is raised by collision with the crushing shot. In particular, in cases in which the indentations and protrusions formed on the metal product surface had been formed by performing fine particle peening using the indentation-protrusion forming shot described above, the compressive residual stress imparted to the surface of the metal product when forming the indentations and protrusions can be maintained, and the increase in surface hardness achieved when forming the indentations and protrusions can be maintained. Moreover, a further increase in the compressive residual stress and in the surface hardness can be achieved accompanying collision with the crushing shot.

As a result, the surface roughness of the metal product is improved by the burnishing method of the present invention. In cases in which the metal product is a sliding component, breaks in the oil film are prevented by forming the indentations serving as oil traps thereon, and the advantageous effects of improved fatigue strength, durability, and wear resistance that accompany a rise in the compressive residual stress and surface hardness are also obtained. A reduction in the sliding resistance is also achieved at the same time accompanying the improvement in surface roughness obtained by pressing and collapsing the protrusions.

Furthermore, in cases in which the burnishing method of the present invention is applied to a molding surface of a mold or the like, the following advantageous effect can be achieved at the same time: an improvement in demoldability due forming release agent traps and air traps by forming the indentations; an improvement in fatigue strength by imparting compressive residual stress and raising surface hardness; and an improvement in durability, wear resistance, and the like. At the same time the advantageous effect of an improvement in demoldability can be achieved due to the surface roughness being improved by pressing and collapsing the protrusions.

EXAMPLES

Test Example 1

(1) Test Objective

For a metal product surface having indentations and protrusions formed thereon by blast processing using spherical shaped shot, to confirm whether or not an improvement in surface roughness (burnishing effect) can be obtained in cases in which blast processing using shot having a particle diameter approximately the same as that of the shot used to form the indentations and protrusions (indentation-protrusion forming shot) was performed (i.e. follow-up processing: processing not corresponding to the burnishing method of the present invention).

(2) Test Method (2-1) Test Piece

A test piece (30 mm×30 mm×3 mm) made from gas carburized chromium molybdenum steel (SCM 415) was polished with abrasive paper (500 grit) and then indentation-protrusion forming processing and follow-up processing, as described below, was performed thereon.

Note that the surface state of the untreated test piece was as listed in the following Table 1.

TABLE 1

| Surface State of Test Piece (Untreated) (Test Example 1) | |
|---|---|
| Test Piece (30 mm × 30 mm × 3 mm) | SCM 415 gas carburized article (polished with 500 grit abrasive paper) |
| Hardness | 780 HV |
| Surface Roughness | Ra: 0.06 μm Rz: 0.44 μm |
| Surface Compressive Residual Stress | −200 MPa |

(2-2) Indentation-Protrusion Forming Processing

Blast processing was performed on the above test piece (untreated) under the blast processing conditions listed in the following Table 2 so as to form indentations and protrusions on the test piece surface.

Note that the width of the substantially semi-circular arc shaped indentations (i.e. the diameter of the peripheral edge demarcating the outline of the indentations) out of the indentations and protrusions formed was found to be from 0.1 μm to 12 μm, with an average thereof of approximately 5 μm to approximately 6 μm.

TABLE 2

| Indentation-Protrusion Forming Processing Conditions (Test Example 1) | |
|---|---|
| Device Used | Air (gravity) type blasting apparatus |
| Ejection Pressure | 0.5 MPa |
| Nozzle | φ 5 mm long |
| Ejection Distance | 150 mm |
| Ejection Time | approximately 30 seconds for entire surface |
| Shot Used | Substance: steel beads<br>Grain Size: 300 grit (from 37 μm to 74 μm)<br>Hardness: 700 HV to 800 HV |

(2-3) Follow-Up Processing

The test piece having indentation/protrusion formed thereon was then subjected to follow-up processing under the blast processing conditions listed in the following Table 3.

TABLE 3

| Follow-Up Processing Conditions | |
|---|---|
| Device Used | Air (gravity) type blasting apparatus |
| Ejection Pressure | 0.4 MPa |
| Nozzle | φ 9 mm |

TABLE 3-continued

| Follow-Up Processing Conditions | |
|---|---|
| Ejection Distance | 100 mm |
| Ejection Time | Approximately 30 seconds for entire surface |
| Shot Used | Substance: alumina beads<br>Grain size: 300 grit (from 45 μm to 63 μm)<br>Hardness: 800 HV |

(3) Test Results

Figure 3:
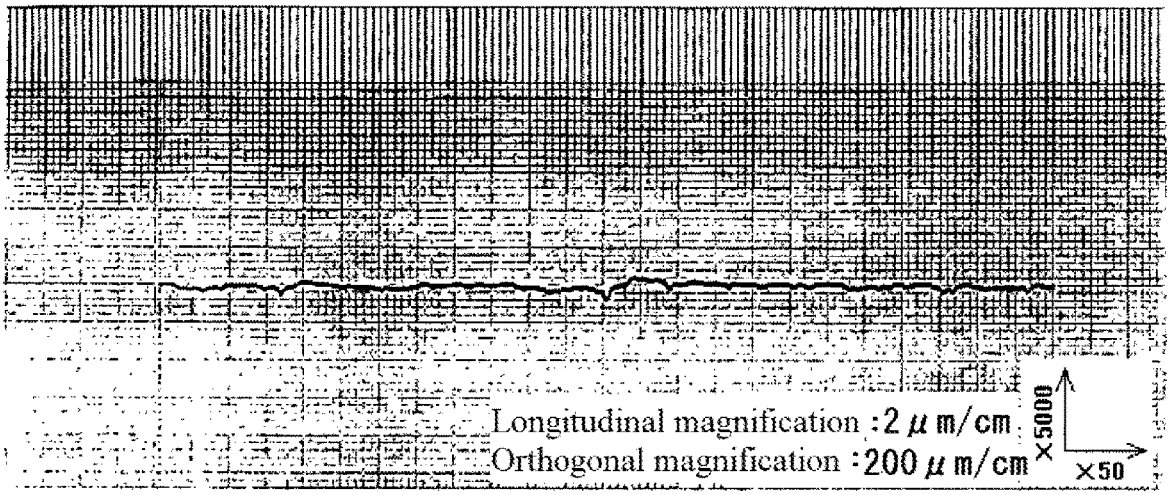
FIG. 3 is a roughness profile of a surface of a test piece (untreated) in a Test Example 1.

The untreated state, and changes to the surface state of the test piece after the indentation-protrusion forming processing and after the follow-up processing, are listed in the following Table 4. The surface roughness profile of the test piece at each step is also illustrated in FIG. 3 (untreated), in FIG. 4 (after indentation-protrusion forming processing), and in FIG. 5 (after follow-up processing).

TABLE 4

Figure 4:
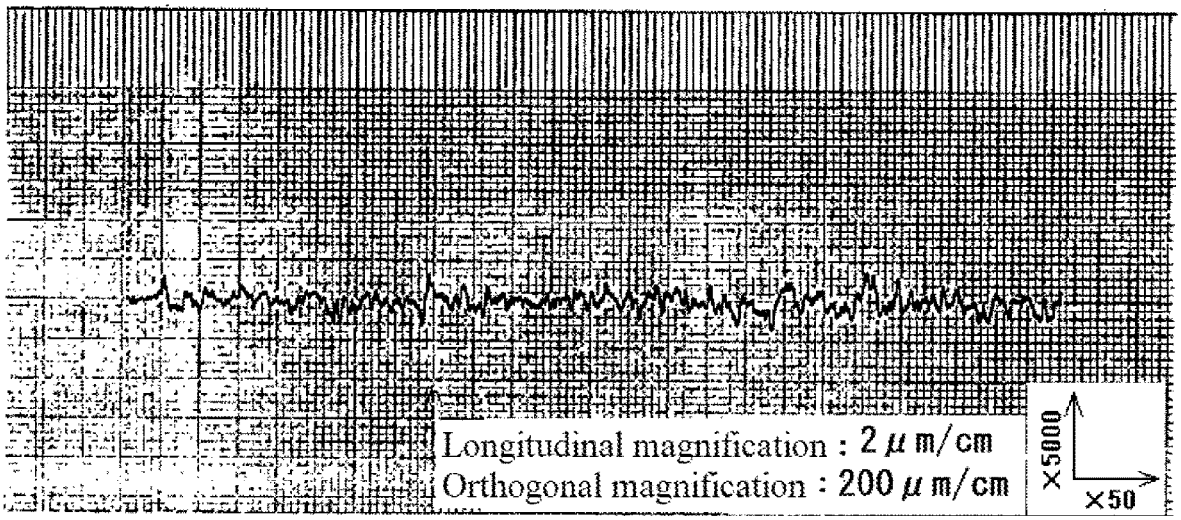
FIG. 4 is a roughness profile of a surface of a test piece (after indentation-protrusion forming processing) in the Test Example 1.
Figure 5:
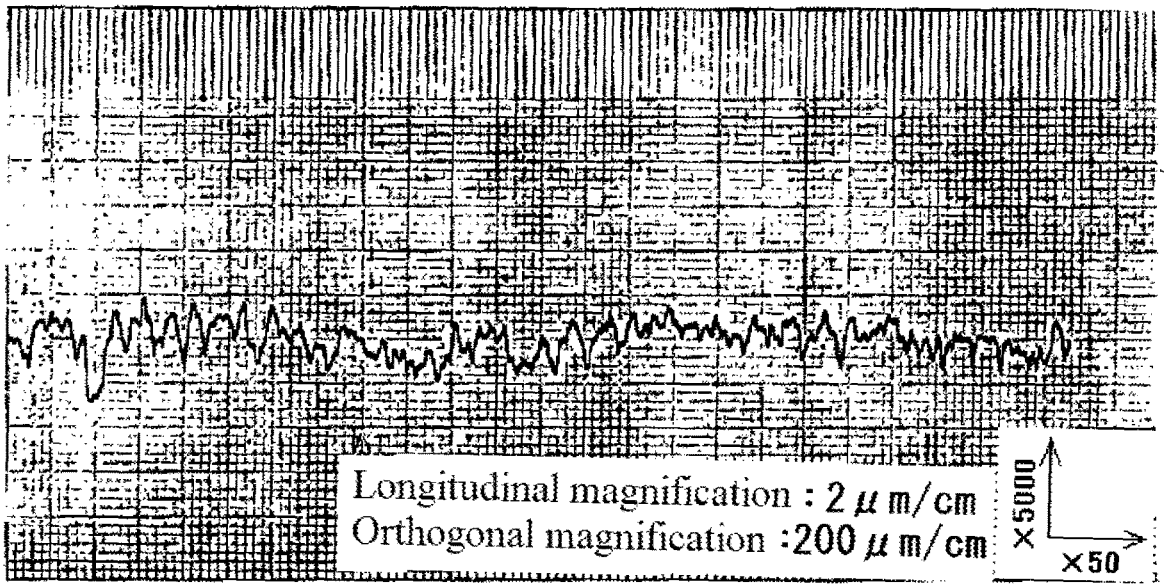
FIG. 5 is a roughness profile of a surface of a test piece (after follow-up processing) in a Test Example 1.
Figure 6:
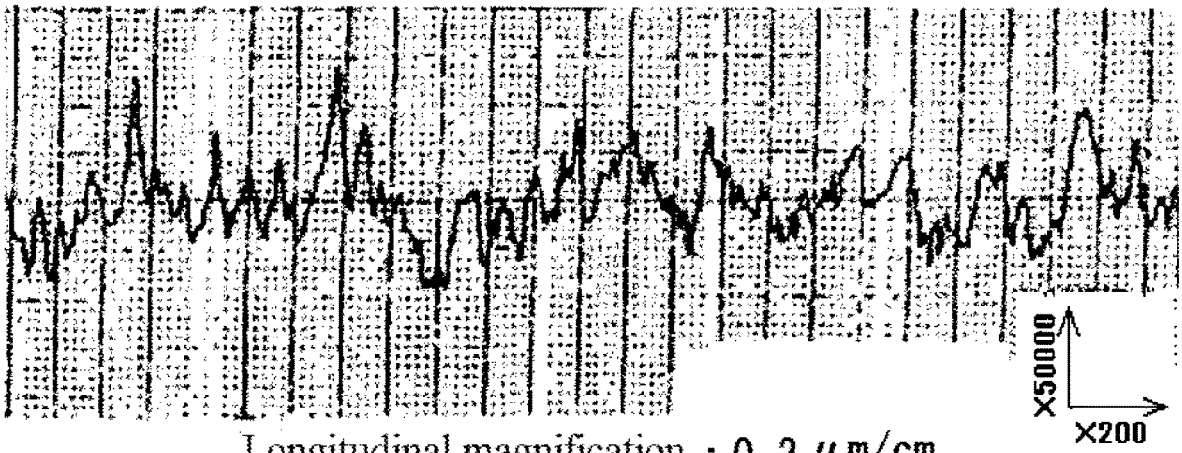
FIG. 6 is a roughness profile of a surface of a test piece (untreated) in the Test Example 2.
Figure 7:
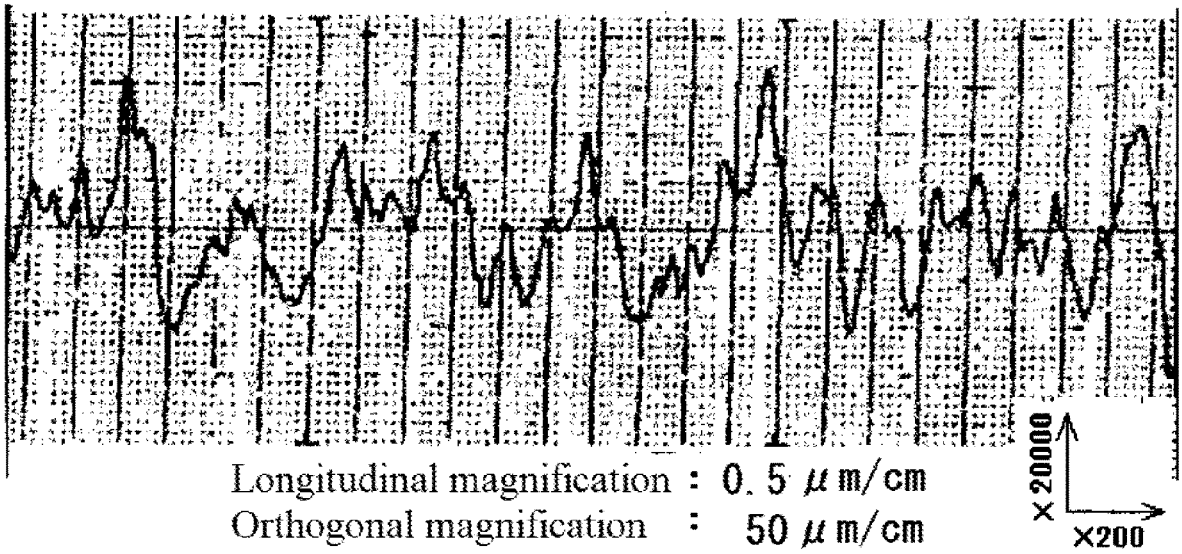
FIG. 7 is a roughness profile of a surface of a test piece (after indentation-protrusion forming processing) in the Test Example 2.

| Changes in Surface State of Test Piece at Each Step (Test Example 1: FIG. 3 to FIG. 4) | | Untreated (FIG. 3) Polished with abrasive paper (500 grit) | After indentation-protrusion forming processing (FIG. 4) | After follow-up processing (FIG. 5) |
|---|---|---|---|---|
| Hardness (HV) | | 780 | 900 | 970 |
| Surface roughness (μm) | Ra | 0.06 | 0.16 | 0.29 |
| | Rz | 0.44 | 1.26 | 1.76 |
| | Ry | 0.60 | 1.42 | 2.26 |
| Compressive residual stress (MPa) | | −200 | −1100 | −1300 |

(4) Interpretation

The above test results have been able to confirm that the surface hardness and the compressive residual stress of a metal product after the follow-up processing can be improved compared to after the indentation-protrusion forming processing even in cases in which the particle diameter of the shot employed for the follow-up processing is approximately the same particle diameter as the shot that was employed in the indentation-protrusion forming processing.

However, with regard to surface roughness, there was a large increase in roughness with respect to the untreated surface roughness with the progression in processing to after the indentation-protrusion forming processing, and the progression in processing to after the follow-up processing.

The above results confirmed that after the indentation-protrusion forming processing, the surface roughness could not be improved therefrom when this processing is followed by blast processing using shot having a particle diameter approximately the same as that of the indentation-protrusion forming shot (i.e. processing outside the range of the burnishing method of the present invention).

Test Example 2

(1) Test Objective

For a metal product surface having indentations and protrusions formed thereon by blast processing using spherical shaped shot, to confirm whether or not an improvement in surface roughness could be obtained by performing blast processing using shot having a particle diameter larger than that of the indentation-protrusion forming shot and having a lower hardness than the surface hardness of the metal product formed with indentations and protrusions (i.e. by the burnishing method of the present invention). An objective was also to confirm how the surface roughness of the metal product after the burnishing processing changes as the particle diameter of the shot (crushing shot) employed in the burnishing processing is changed.

(2) Test Method (2-1) Test Piece

An Almen strip A type (19 mm×76 mm×1.295 mm±0.025 mm: JIS B 2711 2013) that is a strip of carbon tool steel (SK Material: special polishing steel quench and tempered product of JIS G 3311 2016) was employed as the test piece. Burnishing processing by the method of the present invention was performed to the test piece surface having indentations and protrusions formed thereon by the indentation-protrusion forming processing described later. Shots of different particle diameter were employed in an air (gravity) type blasting apparatus.

The surface state of the test piece (untreated) prior to indentation-protrusion forming processing is listed in Table 5.

TABLE 5

Surface State of Untreated Test Piece (Almen strip A type) Test Example 2: FIG. 6 to FIG. 10)

| | |
|---|---|
| Test Piece (19 mm × 76 mm × 1.295 mm ± 0.025 mm) | Carbon tool steel (SK Material) |
| Hardness | 48 HRC (480 HV) |
| Surface roughness | Ra: 0.059 μm Rz: 0.417 μm |
| Surface flatness | ±0.025 mm |

(2-2) Indentation-Protrusion Forming Processing

The above test piece (untreated) was prepared and indentations and protrusions were formed on the test piece surface under the indentation-protrusion forming processing conditions listed in the following Table 6.

Note that the width of the substantially semi-circular arc shaped indentations (i.e. the diameter of the peripheral edge demarcating the outline of the indentations) from out of the formed indentations and protrusions was from 1 μm to 10 μm, with an average thereof of approximately 4 μm to approximately 5 μm.

TABLE 6

Conditions of Indentation-Protrusion Forming Processing (Test Example 2: FIG. 6 to FIG. 10)

| | |
|---|---|
| Device Used | Air (gravity) type blasting apparatus |
| Ejection Pressure | 0.4 MPa |
| Nozzle | φ 9 mm |
| Ejection Distance | 100 mm |
| Ejection Time | 20 seconds for entire surface while swinging nozzle |
| Shot Used | Substance: HSS (High-Speed Steel)<br>Grain size: 400 grit (from 30 μm to 53 μm)<br>Hardness: approximately 1000 HV |

(2-3) Burnishing Processing

Test pieces that had been subjected to the indentation-protrusion forming processing under the above conditions were then subjected to burnishing processing by the method of the present invention under the respective blast processing conditions of Conditions 1 to 3 listed in the following Table 7.

TABLE 7

Burnishing Processing Conditions

| Device Used | | Condition 1 Air (gravity) type blasting apparatus | Condition 2 Air (gravity) type blasting apparatus | Condition 3 Air (gravity) type blasting apparatus |
|---|---|---|---|---|
| Ejection Pressure | | 0.4 MPa | 0.4 MPa | 0.4 MPa |
| Nozzle | | φ 9 mm | φ 9 mm | φ 9 mm |
| Ejection Distance | | 100 mm | 100 mm | 100 mm |
| Ejection Time | | 20 seconds for entire surface while swinging nozzle | 25 seconds for entire surface while swinging nozzle | 30 seconds for entire surface while swinging nozzle |
| Shot Used | Substance | SUS 304 | SUS 304 | SUS 304 |
| | Grain size | 300 grit (from 37 μm to 74 μm) | 150 grit (from 44 μm to 125 μm) | 80 grit (from 105 μm to 250 μm) |
| | Hardness: | 400 HV to 600 HV | 400 HV to 600 HV | 400 HV to 600 HV |

(3) Test Results

The surface state of the test pieces after the indentation-protrusion forming processing, and changes to the test piece surface state after the burnishing processing, are listed in the following Table 8.

Figure 8:
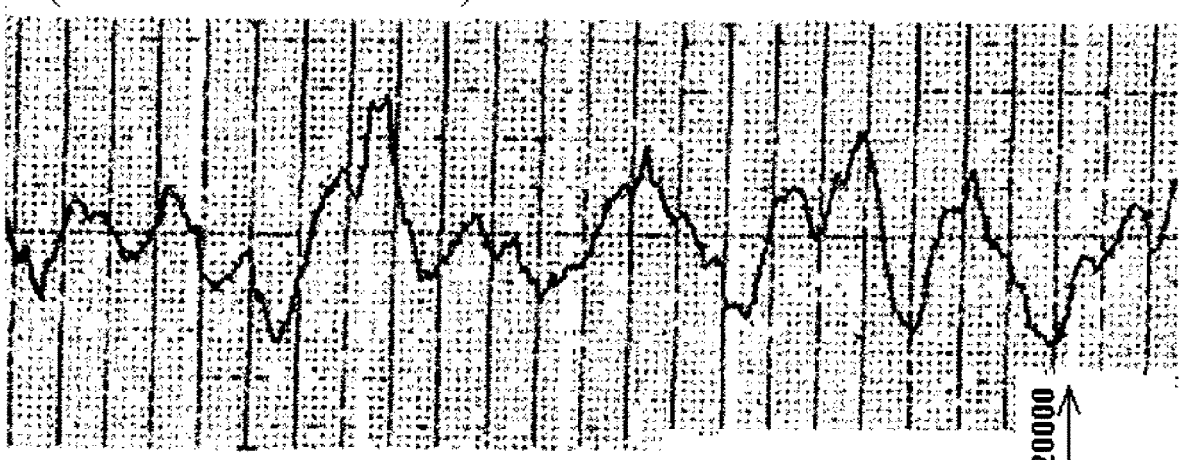
FIG. 8 is a roughness profile of a surface of a test piece (after burnishing processing under Condition 1) in the Test Example 2.
Figure 9:
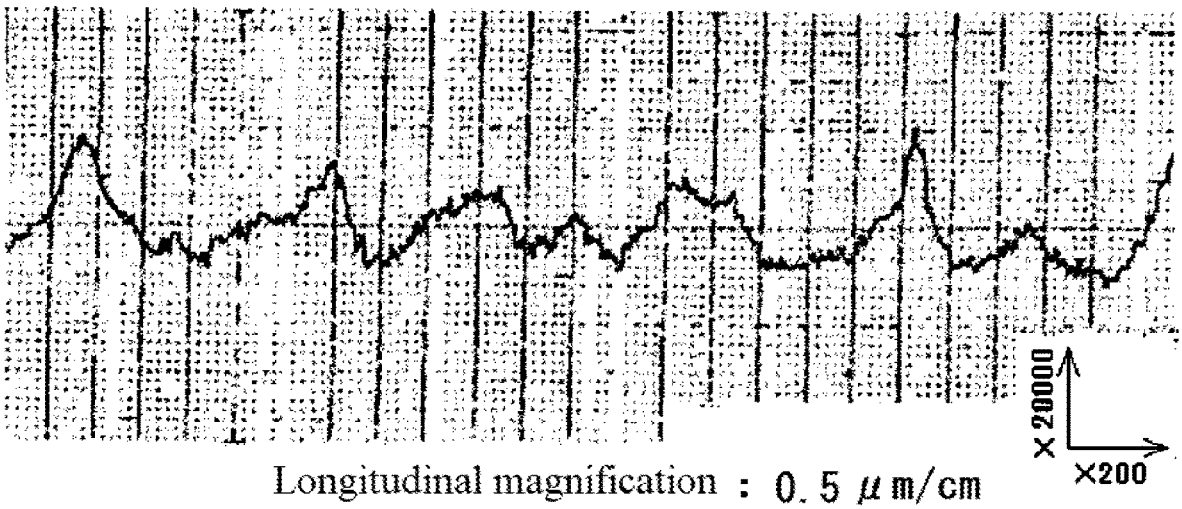
FIG. 9 is a roughness profile of a surface of a test piece (after burnishing processing under Condition 2) in the Test Example 2.
Figure 10:
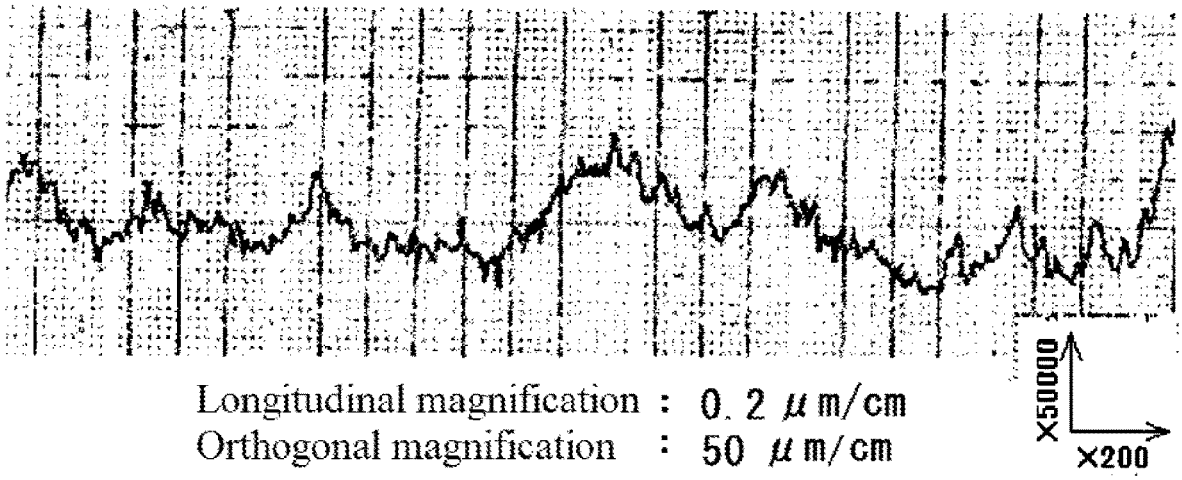
FIG. 10 is a roughness profile of a surface of a test piece (after burnishing processing under Condition 3) in the Test Example 2.

Note that the surface roughness profiles of each test piece are illustrated in FIG. 6 to FIG. 10: untreated (FIG. 6), after indentation-protrusion forming processing (FIG. 7), after burnishing processing with Conditions 1 to 3 (FIG. 8 to FIG. 10).

TABLE 8

Changes to Test Piece Surface State Before/After Processing (FIG. 7 to FIG. 10)

| | | After Indentation/ Protrusion Forming | After Burnishing Processing | | |
|---|---|---|---|---|---|
| | | Processing | Condition 1 | Condition 2 | Condition 3 |
| Shot used | Particle Diameter (grit) | 400 | 300 | 150 | 80 |
| | Particle Diameter (μm) | 30 to 53 | 37 to 74 | 44 to 125 | 105 to 250 |
| | Substance | HSS | SUS 304 | SUS 304 | SUS 304 |
| | Hardness (HV) | 1000 | 400 to 600 | 400 to 600 | 400 to 600 |
| Test Piece Surface | Hardness (HV) | 620 | 650 | 680 | 700 |
| | Surface Roughness (μm) Ra | 0.224 | 0.196 | 0.122 | 0.060 |
| | Surface Roughness (μm) Rz | 1.358 | 1.078 | 0.687 | 0.335 |
| | Compressive Residual Stress (MPa) | −730 | −750 | −780 | −800 |

(4) Interpretation

The above test results have been able to confirm that the burnishing processing of the present invention, which is performed using crushing shot having a larger particle diameter than the shot used for indentation-protrusion forming processing (indentation-protrusion forming shot) and a lower hardness than the hardness of the metal product surface after being formed with indentations and protrusions, does not cause a loss of the surface hardness and compressive residual stress that had been raised in the test pieces by the indentation-protrusion forming processing. Not only does it not cause a loss of these properties, but the burnishing processing of the present invention is also able to improve the surface roughness of the test pieces while actually raising these properties further.

Moreover, the results of Test Example 2 confirmed that for indentation-protrusion forming shot of diameter from 30 μm to 53 μm, such rises in both the surface hardness and compressive residual stress were obtained at the same time as an improvement in surface roughness when the particle diameter of the crushing shot used in burnishing processing was in a range of from 37 μm (the lower limit of Condition 1) to 250 μm (the upper limit of Condition 3). An improvement in surface roughness was accordingly confirmed when the crushing shot used in the burnishing processing was shot having a diameter in a range of from 1.2 (37/30) times to 8.3 (250/30) times that of the indentation-protrusion forming shot.

Moreover, as the particle diameter of the crushing shot used in the burnishing processing gets larger, the rise in surface hardness was higher and the compressive residual stress imparted was confirmed to be greater, and the advantageous effect of improved surface roughness was also confirmed to be greater.

Test Example 3

(1) Test Objective

For a metal product surface having indentations and protrusions formed thereon by blast processing using spherical shaped shot, to confirm whether or not an improvement in surface roughness, increased slidability and wear resistance, and extended lifespan could be obtained by performing blast processing using shot having a particle diameter larger that of the indentation-protrusion forming shot and having a lower hardness than the surface hardness of the metal product formed with indentations and protrusions (i.e. by performing the burnishing method of the present invention).

(2) Test Method (2-1) Test Piece

A shaft (polished product: φ 6.6 mm×123 L) made from SCM 440H (tempered material) was employed as the test piece. Burnishing processing according to the method of the present invention was performed on the test piece surface having indentations and protrusions formed thereon by the indentation-protrusion forming processing described later. Shot (crushing shot) having a particle diameter larger than that of the indentation-protrusion forming shot and having a lower hardness than the surface hardness of the metal product formed with indentations and protrusions was employed in an air (direct) type blasting apparatus.

Note that the surface state of the test piece (untreated) prior to the indentation-protrusion forming processing is listed in Table 9.

TABLE 9

| Surface State of Test Piece (Untreated) (Test Example 3) | | |
|---|---|---|
| Shaft φ 6.6 mm × 123 L | | SCM 440H tempered polished product |
| Hardness | | 37 to 41 HRC (365 to 405 HV) |
| Surface roughness (μm) | Ra | 0.2107 |
| | Rz | 0.4825 |
| Surface compressive residual stress (MPa) | | −200 |

(2-2) Indentation-Protrusion Forming Processing

Indentations and protrusions were formed on the surface of the test piece described above by performing blast processing under the blast processing conditions listed in the following Table 10.

TABLE 10

| Indentation-Protrusion Forming Processing Conditions | |
|---|---|
| Device Used | Air (gravity) type blasting apparatus |
| Ejection Pressure | 0.3 MPa |
| Nozzle | φ 9 mm |
| Ejection Distance | 150 mm (100 mm nozzle swing) |
| Ejection Time | surface φ 6.6 mm × 65 L portion 20 seconds |
| Shot Used | Substance: alumina-silica beads (FHB)<br>Grain size: 400 grit (from 38 μm to 53 μm), average 45 μm<br>Hardness: 800 HV |

(2-3) Burnishing Processing

Burnishing processing was performed under the blast processing conditions listed in the following Table 11 on the test piece resulting from the indentation-protrusion forming processing described above.

TABLE 11

| Burnishing Processing Conditions | |
|---|---|
| Device Used | Air (gravity) type blasting apparatus |
| Ejection Pressure | 0.4 MPa |
| Nozzle | φ 5 mm |
| Ejection Distance | 200 mm (100 mm nozzle swing) |
| Ejection Time | surface φ 6.6 mm × 65 L portion 20 seconds |
| Shot Used | Substance: SUS316L<br>Grain size: 300 grit (from 37 μm to 74 μm), average 55.5 μm<br>Hardness: 250 HV (in production) |

(3) Test Results

An untreated state, and changes to each test piece surface state after indentation-protrusion forming processing and after burnishing processing are listed in the following Table 12. The surface roughness profiles of the test piece at each step are respectively illustrated in FIG. 11 (untreated), FIG. 12 (after indentation-protrusion forming processing), and FIG. 13 (after burnishing processing).

Note that the roughness (shaft surface roughness) was measured using a Hybrid Contour and Roughness Measuring Instrument SEF-3400 manufactured by Kosaka Laboratory Ltd. (speed: 0.05 mm/s; cutoff λc value: 0.8 mm; filter: 2CR; length: 0.80 mm; polarity: normal).

TABLE 12

Figure 11:
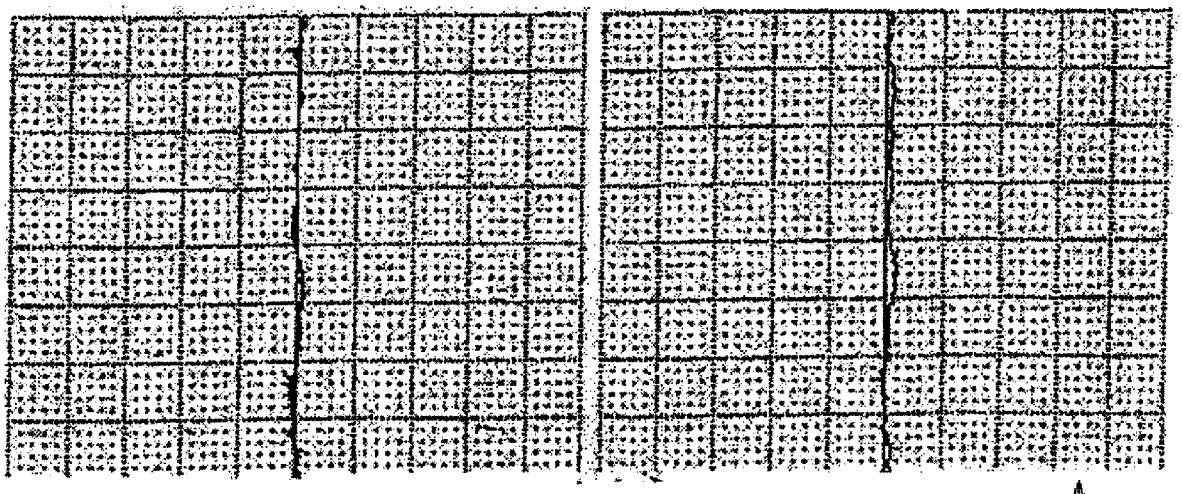
FIG. 11 is a roughness profile of a surface of a test piece (untreated) in a Test Example 3.
Figure 11:
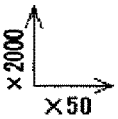
Figure 12:
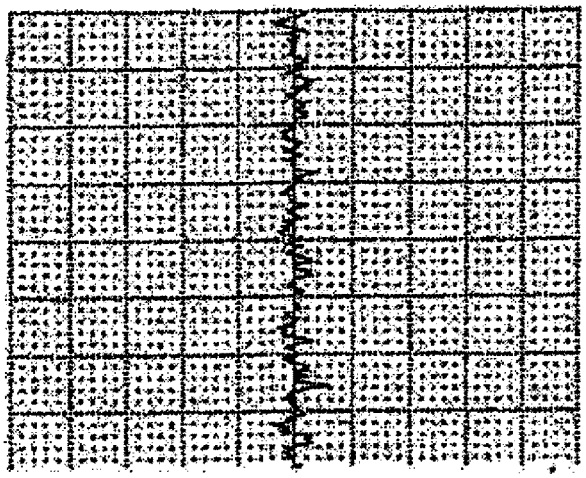
FIG. 12 is a roughness profile of a surface of a test piece (after indentation-protrusion forming processing) in the Test Example 3.
Figure 12:
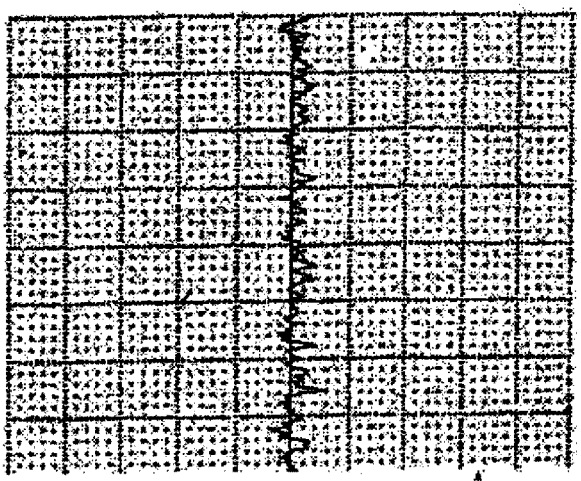
Figure 13:
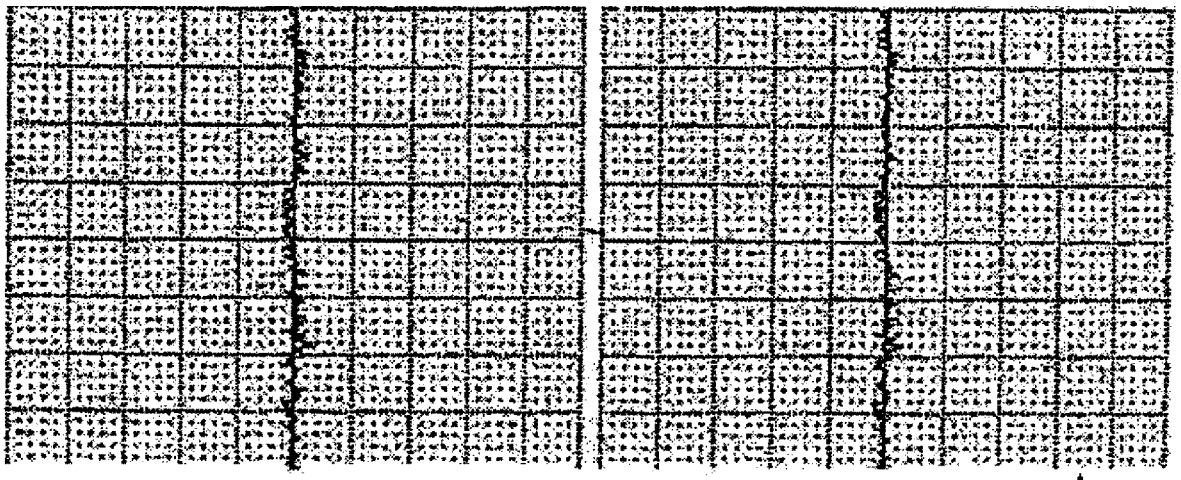
FIG. 13 is a roughness profile of a surface of a test piece (after burnishing processing) in the Test Example 3.

Changes in Surface State of Test Piece at Each Step (Test Example 3: FIG. 11 to FIG. 13)

| | | Untreated (FIG. 11) polished | After indentation-protrusion forming processing (FIG. 12) | After burnishing processing (FIG. 13) |
|---|---|---|---|---|
| Hardness (HV) | | 380 | 450 | 460 |
| Surface roughness (μm) | Ra | 0.2107 | 0.3051 | 0.1631 |
| | Rz | 0.4825 | 1.648 | 0.9075 |
| | Rmax | 0.7000 | 2.438 | 1.288 |
| Compressive residual stress(MPa) | | −200 | −350 | −370 |

(4) Interpretation

The above test results have been able to confirm that the burnishing processing of the present invention, which is performed using crushing shot having a larger particle diameter than shot used for indentation-protrusion forming processing (indentation-protrusion forming shot) and a lower hardness than the surface hardness of the metal product after indentation-protrusion forming, does not cause a loss of the surface hardness and compressive residual stress that had been raised in the shaft by the indentation-protrusion forming processing. Not only does it not cause a loss of these properties, but the burnishing processing of the present invention is actually able to improve the surface roughness of the while further raising these properties, and the advantageous effects of increased slidability and wear resistance, and extended lifespan could be obtained thereby.

What is claimed is:

1. A burnishing method for a metal product surface member, the burnishing method comprising:

using a metal product including a surface having indentations and protrusions formed by blast processing as a treatment target; and ejecting spherical shaped shot having a lower hardness than a surface hardness of the metal product and a particle diameter larger than a width of the indentation from out of the indentations and the protrusions and having a larger particle diameter than a projection material used for the blast processing against the metal product surface as crushing shot, and causing the crushing shot to collide the metal product surface so as to selectively press and collapse the protrusions from out of the indentations and protrusions formed on the surface of the metal product and improve a surface roughness of the metal product, wherein: the metal product serving as the treatment target has indentations and protrusions formed on a surface by ejecting, as an indentation-protrusion forming shot, spherical shaped shot having a hardness that is not less than a hardness of a base material of the metal product serving as the treatment target and selected from a range of an average particle diameter of from 20 pm to 149 pm against the metal product surface; and shot employed as the crushing shot has a particle diameter larger than that of the indentation-protrusion forming shot and is selected from a range of from an average particle diameter of from 24 pm to 840 pm.

2. The burnishing method for the metal product surface member of claim 1, wherein ejection of the crushing shot is performed at an ejection pressure of from 0.1 MPa to 0.7 MPa or at an ejection velocity of from 30 m/s to 300 m/s.

3. The burnishing method for the metal product surface member of claim 1, wherein the particle diameter of the crushing shot is in a range of from 1.2 times to 8.3 times the particle diameter of the indentation-protrusion forming shot.

* * * * *